US010337136B1

(12) United States Patent
Fallah et al.

(10) Patent No.: US 10,337,136 B1
(45) Date of Patent: Jul. 2, 2019

(54) APPARATUS FOR DRYING CLOTHES

(71) Applicants: Austin S. Fallah, Plymouth, MN (US); Maritha F. Jonah, Brooklyn Center, MN (US)

(72) Inventors: Austin S. Fallah, Plymouth, MN (US); Maritha F. Jonah, Brooklyn Center, MN (US)

( * ) Notice: Subject to any disclaimer, the term of this patent is extended or adjusted under 35 U.S.C. 154(b) by 0 days.

(21) Appl. No.: 15/907,732

(22) Filed: Feb. 28, 2018

(51) Int. Cl.

| | |
|---|---|
| ***A47K 3/32*** | (2006.01) |
| ***A47K 3/28*** | (2006.01) |
| ***D06F 57/06*** | (2006.01) |
| ***A47B 43/00*** | (2006.01) |
| ***A47B 61/02*** | (2006.01) |

(52) U.S. Cl.
CPC ..... *D06F 57/06* (2013.01); *A47B 43/00* (2013.01); *A47B 61/02* (2013.01)

(58) Field of Classification Search
CPC ..... D06F 57/06; D06F 57/12; D06F 57/08; A47B 61/06; A47B 43/04; A47K 3/325
See application file for complete search history.

(56) References Cited

U.S. PATENT DOCUMENTS 1,857,617 A * 5/1932 Berdon ..... D06F 57/08 211/119.011
2,445,403 A * 7/1948 Mayerman ..... D06F 58/14 211/202
2,473,047 A * 6/1949 Bershad ..... D06F 57/12 126/9 R
2,656,932 A * 10/1953 Carr ..... D06F 57/02 211/113
2,701,921 A * 2/1955 Strongson ..... D06F 58/14 219/400
2,852,784 A * 9/1958 Winkler ..... A47K 3/325 4/599
3,023,912 A * 3/1962 Sebastian ..... A47G 25/0664 211/196
3,130,838 A * 4/1964 Holka ..... D06F 58/14 211/113
3,144,946 A * 8/1964 Ellis ..... A47F 7/24 211/182
3,391,409 A * 7/1968 Gatley ..... A47K 3/325 4/599
3,646,618 A * 3/1972 Johnson ..... A47K 3/325 4/597
3,675,338 A * 7/1972 Maki ..... D06F 57/06 211/189
3,905,125 A * 9/1975 Hubner ..... D06F 58/14 34/622

(Continued)

FOREIGN PATENT DOCUMENTS

CN 103498321 A * 1/2014 ..... D06F 57/02
GB 1232941 A * 5/1971 ..... D06F 57/08

*Primary Examiner* — Kimberley S Wright
(74) *Attorney, Agent, or Firm* — Sanchelima & Associates, P.A.; Christian Sanchelima; Jesus Sanchelima

(57) ABSTRACT

An apparatus for drying clothes is disclosed. The apparatus comprises a container. The container comprises walls and a base. The apparatus further comprises a plurality of first poles placed vertically with respect to the container. The apparatus further comprises a plurality of second poles placed at an angle with respect to the plurality of first poles. Wet clothes are hanged at the plurality of second poles such that water dripping from the clothes is collected in the container.

6 Claims, 4 Drawing Sheets

(56) References Cited

U.S. PATENT DOCUMENTS 3,946,878 A * 3/1976 Stoveken ..... B42D 17/00 211/124
4,413,363 A * 11/1983 Troiano ..... A47K 3/325 4/596
4,592,473 A * 6/1986 Efrom ..... D06F 57/00 211/189
5,412,928 A * 5/1995 Reithel ..... A47L 23/205 34/104
5,544,369 A * 8/1996 Roberts ..... A47K 3/325 4/599
5,555,640 A * 9/1996 Ou ..... A47L 19/00 211/133.6
5,564,138 A * 10/1996 Simpson ..... A47K 3/325 4/599
5,649,867 A * 7/1997 Briggs ..... A63B 9/00 472/128
5,755,040 A * 5/1998 Ou ..... A47L 23/205 34/202
5,790,992 A * 8/1998 Ray ..... A47K 3/325 4/599
5,970,536 A * 10/1999 Suarez ..... A47K 3/325 4/599
7,036,670 B2 5/2006 Lam
7,047,577 B1 * 5/2006 Cirilli ..... A47K 3/325 4/599
7,104,412 B2 * 9/2006 Yong ..... D06F 57/06 211/123
9,565,932 B2 * 2/2017 Hirsch ..... A47B 61/06
9,739,531 B2 * 8/2017 Goulet ..... F26B 9/06
9,820,542 B2 * 11/2017 McKelvey ..... A45C 9/00
2003/0006206 A1 * 1/2003 Jackson ..... D06F 57/08 211/119.01
2005/0029213 A1 * 2/2005 Yong ..... D06F 57/06 211/206
2007/0051686 A1 * 3/2007 Sausman ..... D06F 57/06 211/85.3
2008/0040851 A1 * 2/2008 Jackson ..... A47K 3/288 4/599
2008/0222909 A1 * 9/2008 Picozza ..... D06F 58/14 34/195
2008/0256989 A1 * 10/2008 Jeong ..... D06F 58/14 68/5 C
2009/0000894 A1 * 1/2009 Middup ..... A45C 5/14 190/15 R
2009/0321204 A1 * 12/2009 Barkow ..... A45C 13/02 190/8
2014/0262659 A1 * 9/2014 Hirsch ..... A47B 61/06 190/13 R
2016/0213111 A1 * 7/2016 Aiello ..... A45C 9/00
2017/0071302 A1 * 3/2017 McKelvey ..... A45C 9/00
2018/0070689 A1 * 3/2018 McKelvey ..... A45C 9/00

* cited by examiner

APPARATUS FOR DRYING CLOTHES

OTHER RELATED APPLICATIONS

The present application does not claim priority from any other application.

FIELD OF THE INVENTION

The present disclosure generally relates to an apparatus for drying clothes. More specifically, the present disclosure relates to an apparatus for drying clothes, which is movable and can easily be stored away when not in use.

DESCRIPTION OF THE RELATED ART

Generally, people in household dry clothes outdoors. However, clothes such as innerwear including but not limited to underwear, vests, and bras are dried indoors. Typically, the innerwear when wet is left for drying in bathroom using hangers or rods provided in the bathroom. In certain situations, the innerwear may be put to dry in bedrooms due to space constraints in the bathroom or due to climatic conditions. It may be embarrassing for a homeowner when a guest walks into the bedroom and sees the innerwear left for drying in the bathroom or the bedroom.

In order to overcome the problem of drying clothes indoors, several attempts have been proposed in the past. One such attempt includes providing an apparatus in a square or rectangular shape having a hanger and a dryer. The clothes may be hanged with the help of the hanger and the dryer may be used to dry the clothes. One such example was disclosed in U.S. Pat. No. 7,036,670, filed by Peter Ar-Fu Lam. Peter Ar-Fu Lam disclosed an apparatus comprising supporting rods forming a square or rectangular frame. The apparatus further comprises a garment hanger having a medial portion and two supporting arms extending at an obtuse angle from said medial portion. In one example, the garment hanger is provided with a dryer for drying clothes hanged to the garment hanger.

It should be understood that the above design has drawbacks. For instance, when wet clothes are hanged to the garment hanger, water may drip at the bottom of the apparatus and may leak on to the floor. Further, the apparatus requires dryer which will make noise and the apparatus becomes unpleasant to use indoors. Furthermore, the apparatus is difficult to move from one place to another.

Other documents describing the closest subject matter provide for a number of more or less complicated features that fail to solve the problem in an efficient and economical way. None of the patents suggest the novel features of the present invention.

Therefore, there is a need in the art for an apparatus for drying clothes, which is movable and can easily be stored away when not in use. Further, the apparatus should be easy to make and require less number of parts.

SUMMARY OF THE INVENTION

It is one of the main objects of the present invention to provide an apparatus for drying clothes that avoids the drawbacks of the prior art.

It is one object of the present invention to provide an apparatus for drying clothes, which is easy to make and is movable.

It is another object to provide an apparatus comprising a container having a plurality of first poles that are collapsible to adjust the height. The apparatus further comprises a plurality of second poles placed at an angle with respect to the plurality of first poles. The plurality of second poles may be used to dry clothes such as underwear, vests etc. of a user.

It is another object to provide clips at the plurality of second poles to hand wet clothes for drying such that water from the clothes is made to drip within the container.

It is another object to provide an apparatus comprising wheels, which facilitates in moving the apparatus from one place to another.

It is another object to provide a storage box to hold the apparatus in order to transport the apparatus from one place to another.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses an apparatus for drying clothes. The apparatus comprises a container provided in a box-like structure. The container comprises a base having a hole at center. The container comprises wheels for moving the container from one place to another. The container further comprises a plurality of first poles placed at right angle with respect to the base. Each of the plurality of first poles is collapsible indicating that length of the plurality of first poles can be adjusted. Further, the apparatus comprises a plurality of second poles placed horizontally with respect to the base. The plurality of second poles is placed with the support of the plurality of the first poles. The plurality of second poles comprises clips for holding clothes or personal articles of a user such as underwear, vests and so on. When not in use, the plurality of second poles is removed and the plurality of first poles is collapsed and placed in the container. Subsequently, the container may be moved to a corner of a house.

Various features and embodiments of an apparatus for drying clothes are explained in conjunction with the description of FIGS. 1A-5.

Figure 1A:
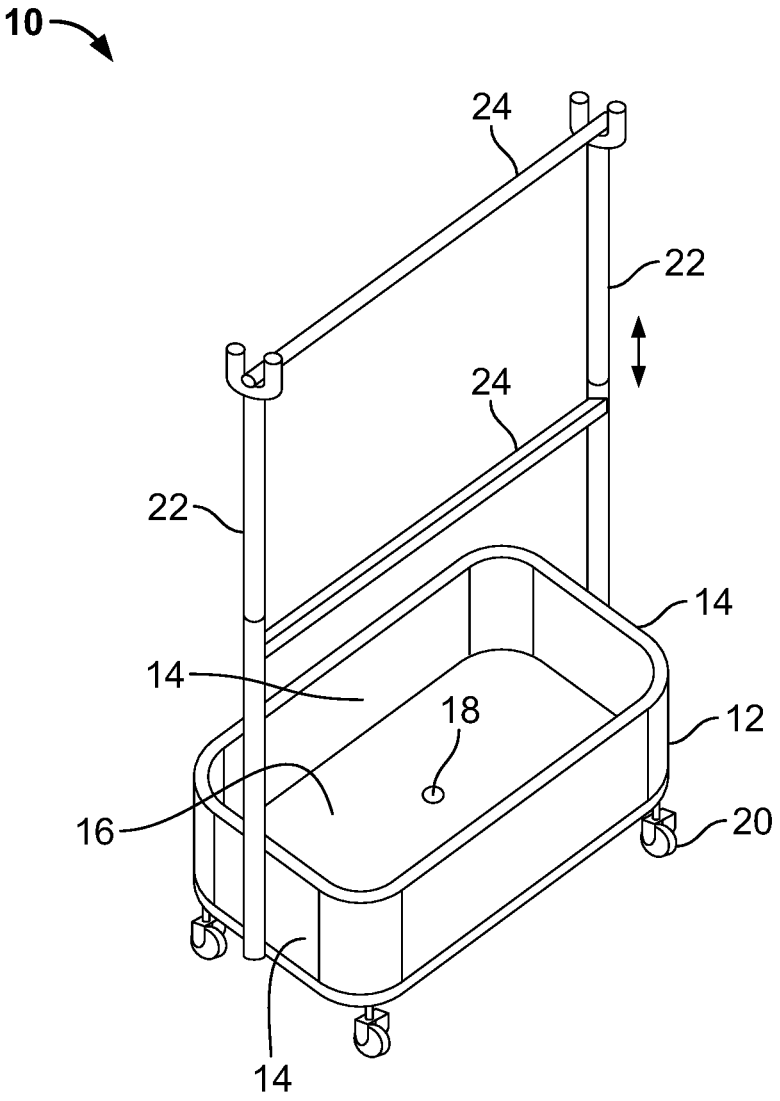
FIGS. 1A, 1B and 1C illustrate a perspective view, a front view and a side view of an apparatus for drying clothes, respectively, in accordance with one embodiment of the present disclosure.
Figure 1B:
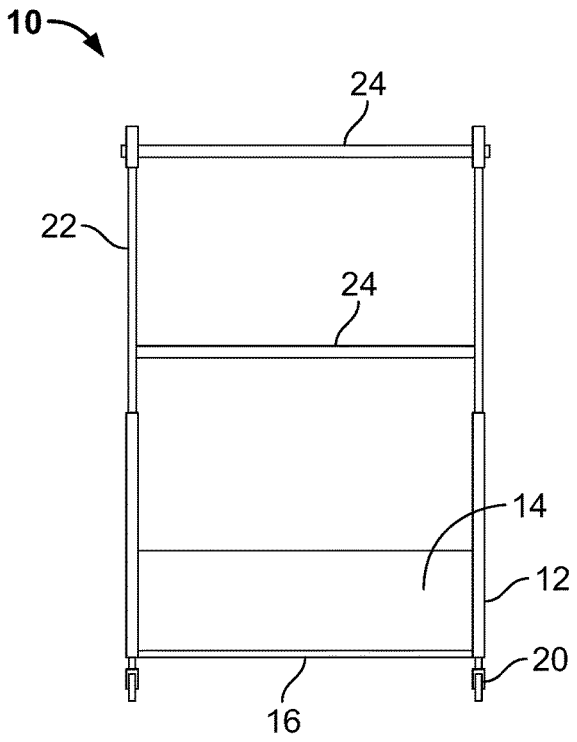
Figure 1C:
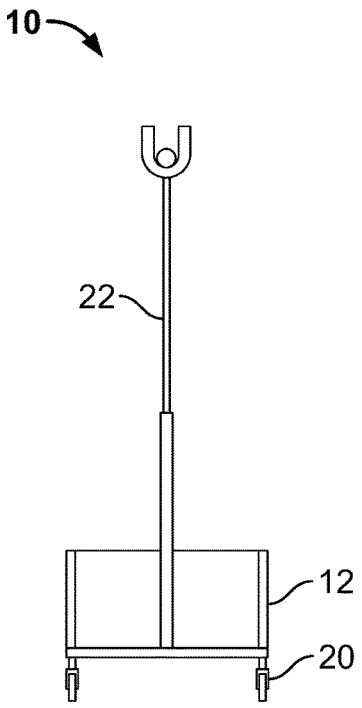
Figure 2:
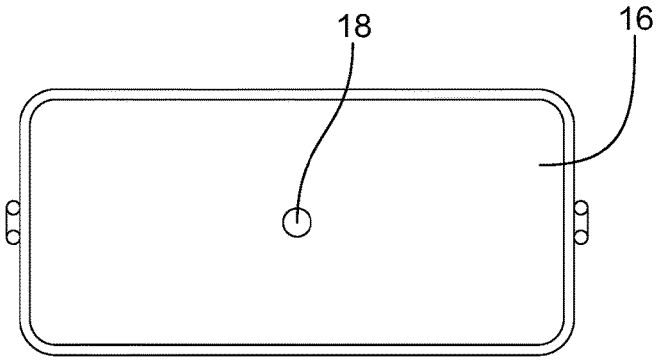
FIG. 2 illustrates a top view of a base of the apparatus, in accordance with one embodiment of the present disclosure.

Referring to FIGS. 1A, 1B and 1C, a perspective view, a front view and a side view of an apparatus 10 used for drying clothes are shown, in accordance with one embodiment of the present disclosure. The apparatus 10 comprises a container 12 provided in a tub or a basin or box-like structure. In one example, the container 12 is made using one of plastic, metal such as aluminum, stainless steel and so on. The container 12 may comprise four walls 14 and a base 16, thereby forming a close structure having one open end. In one implementation, the base 16 may be provided with a hole 18. Referring to FIG. 2, a top view of the base 16 comprising the hole 18 at center is shown, in accordance with one embodiment of the present disclosure. It should be understood the hole 18 may be provided at one or more corners of the base 16 and should not be construed in limited sense.

As can be seen from FIG. 1A, the apparatus 10 may be provided with wheels 20 at each corner of the base 16. The wheels 20 facilitate movement of the apparatus 10 from one place to another. In one implementation, the apparatus 10 comprises a plurality of first poles 22 placed vertically. In other words, the plurality of first poles 22 is placed at right angle with respect to the base 16. The plurality of first poles 22 may be made using plastic, metal such as aluminum, stainless steel and so on. Length of the plurality of first poles 22 may be adjusted by contracting each of the plurality of first poles 22. In one example, the plurality of first poles 22 may be folded in order to reduce the length. In one implementation, the apparatus 10 comprises a plurality of second poles 24 removably coupled to the plurality of first poles 22. The plurality of second poles 24 may be made using plastic, metal such as aluminum, stainless steel and so on. The plurality of second poles 24 is placed horizontally with respect to the base 16. In other words, the plurality of second poles 24 is placed at right angle with respect to the plurality of first poles 22. In another implementation, the plurality of second poles 24 is placed at an acute angle with respect to the plurality of first poles 22.

In the current embodiment, a user of the apparatus 10 may put the clothes such as underwear and vests on the plurality of second poles 24 for drying. In use, when the user puts the wet clothes, water from the clothes may drip in the container 12. Further, the water may be drained at a later time. In one example, water is made to flow through the hole 18 and container 12 is cleaned. As the water is collected in the container 12, the floor is kept clean at all times.

Upon drying the clothes, the user may remove each of the plurality of second poles 24 from the plurality of first poles 22. Subsequently, the user may fold or retract the plurality of first poles 22 and may store in the container 12. Subsequently, the container 12 may be moved to a corner of the house using the wheels 20.

Figure 3:
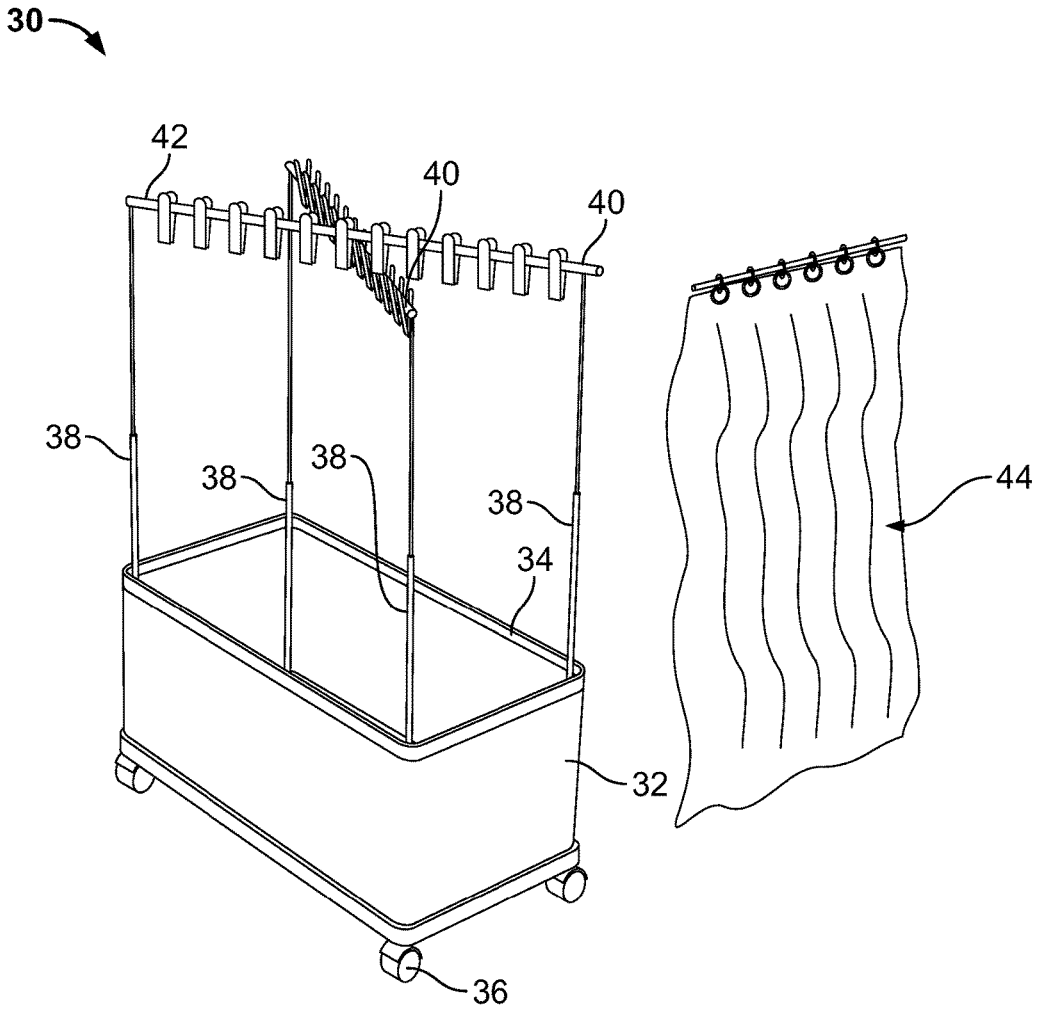
FIG. 3 illustrates an apparatus for drying clothes, in accordance with another embodiment of the present disclosure.

Referring to FIG. 3, an apparatus 30 for drying clothes is shown, in accordance with another embodiment of the present disclosure. The apparatus 30 comprises a container 32 provided in a tub or a basin or box-like structure. In one example, the container 32 is made up using one of plastic, metal such as aluminum, stainless steel and so on. The container 32 may comprise four walls 34 and a base (not shown). In one implementation, the base may be provided with a hole (similar to hole 18).

The apparatus 30 comprise wheels 36 at the base. In one implementation, the apparatus 30 comprises a plurality of first poles 38 placed vertically. In other words, the plurality of first poles 38 is placed at right angle with respect to the base. Length of the plurality of first poles 38 may be adjusted by contracting each of the plurality of first poles 38. In one implementation, the apparatus 30 comprises a plurality of second poles 40 removably coupled to the plurality of first poles 38. The plurality of second poles 40 may be placed horizontally with respect to the base. In one example, the plurality of second poles 40 is placed at right angle with respect to the plurality of first poles 38. In another example, the plurality of second poles 40 is placed at 45 degrees with respect to the plurality of first poles 38 indicating that plurality of second poles 40 are placed in X-shaped fashion or in a square or rectangular fashion.

In one implementation, the plurality of second poles 40 may be provided with a plurality of clips 42 for holding clothes. It should be understood that the plurality of second poles 40 acts as a support structure for the clips 42 which in turn hold the clothes. In use, the clothes may be hanged with the help of the clips 42 such that the water from the clothes may drip in the container 32.

In one implementation, the apparatus 30 may be provided with a curtain 44. The curtain 44 may indicate a cloth made up of suitable material of water resistant capability. The curtain 44 may be coupled at ends of each of the plurality of second poles 40 in order to conceal the clothes from outside view. Length of the curtain 44 may extend until the ground or the container 32.

In use, the user may put the clothes for drying by hanging the clothes using the plurality of clips 42. When the clothes are put for drying, the user may draw the curtain 44 to conceal site of the clothes when viewed from outside. In this way, the apparatus 30 may be placed indoors or outdoors and clothes such as innerwear, vests, bra and so on may be dried without being viewed from outside. Further, the apparatus 30 may be moved easily from one place to another in the house or outdoors using the wheels 36.

Figure 4:
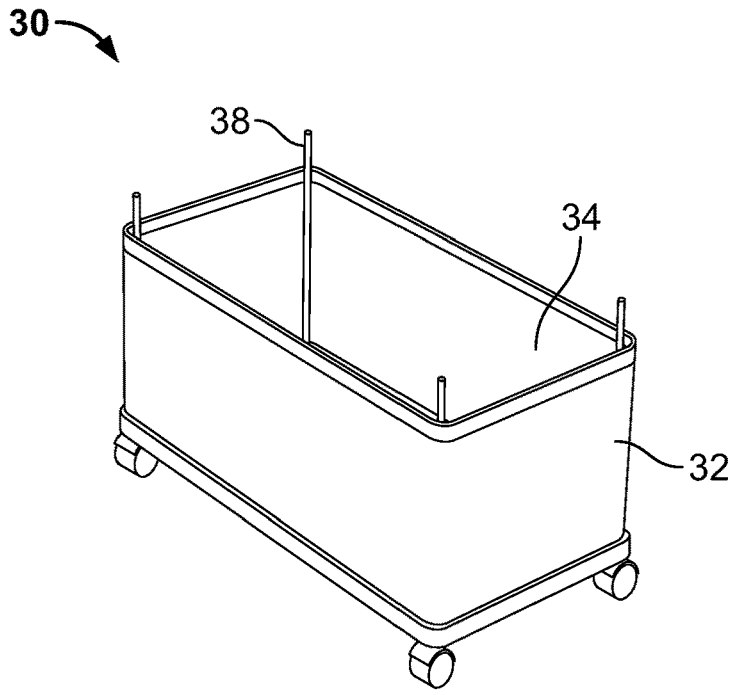
FIG. 4 illustrates the apparatus showing a plurality of first poles contracted, in accordance with another embodiment of the present disclosure.

After drying the clothes, the user may remove the curtain 44. Subsequently, the user may remove the clothes from the clips 42. Further, the user may remove the plurality of second poles 40. Further, the user may retract/fold the plurality of first poles 38, as shown in FIG. 4.

It should be understood that the apparatus 30 may be made in different sizes and shapes depending upon the usage and the structure of the apparatus 30 shown in figures should not taken in limited sense.

Figure 5:
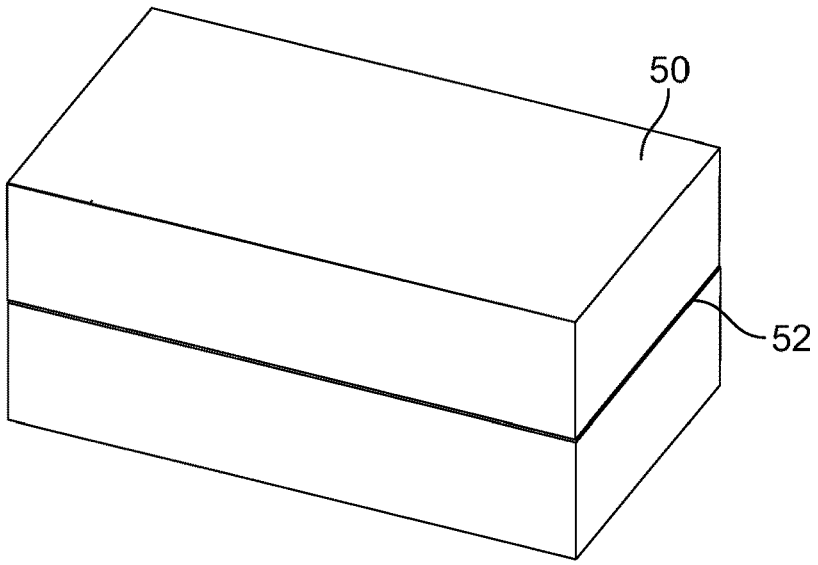
FIG. 5 illustrates a storage box, in accordance with one embodiment of the present disclosure.

In one implementation, the apparatus 30 may be placed in a storage box 50. As shown in FIG. 5, the storage box 50 may include a box-like closed structure for storing the apparatus 30. The storage box 50 may be made up of suitable material, which is water resistant and can withstand wear and tear. In one example, the storage box 50 may include a zipper 52 for accessing the contents stored in the storage box 50. In one example, the storage box 50 may be used to transport the apparatus 30 from one place to another.

As explained above, the apparatus for drying clothes can be used indoors or outdoors. The apparatus facilitates in drying clothes without being seen from outside. The apparatus facilitates in collecting the water dripping from the clothes in the container such that the house is kept clean at all times. Further, the water may be drained using the hole provided at the base. The plurality of first poles can be retraced and stored in the container when not in use, thereby making the entire structure compact and easy to move from one place to another e.g., from one room to another using the wheels. Further, the apparatus may be kept in the storage box in order to transport from one place to another e.g., from one city to another.

It should be understood that the apparatus may be used in households, laundry shops, warehouse and so on. The apparatus may be provided in different shapes and sizes depending upon the need. The shape and size of the container may be selected based on the number of clothes that the user wishes to dry.

In addition, the apparatus may be used to dry other products such as an umbrella and the like and should not be construed to the examples provided herein.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus for drying clothes, the apparatus comprising:

a container including four side walls of the same height, said container having a perimeter;

said four side walls mounted to each other to define four corners and a base having one drain centrally located thereon;

four vertical telescopic poles entirely within said perimeter and extending vertically from said base;

said four vertical telescopic poles each having a topmost distal end and each of said four vertical telescopic poles mounted adjacent to one of said four corners;

said four vertical telescopic poles include a first set of two vertical telescopic poles being diagonally opposite to each other and a second set of the remaining two vertical telescopic poles being diagonally opposite to each other;

a first cross member extending entirely above said first set, said first cross member has two distal ends that are each mounted above the topmost distal ends of the two vertical telescopic poles defining said first set;

a second cross member extending entirely above said second set, said second cross member has two distal ends that are each mounted above the topmost distal ends of the two vertical telescopic poles defining said second set;

said first and second cross member intersecting each other and each of first and second cross member has a length and each of first and second cross member has two opposite distal ends;

a plurality of fasteners mounted entirely along the length of said first and second cross member except at the distal ends of said first and second cross member to make space for each of said four vertical telescopic poles to mount to said first and second cross member, said plurality of fasteners located entirely within said perimeter thereby permitting water dripping from wet clothes to land entirely within said container and on said base;

a wheel assembly including four wheels, one of said four wheels located below each of said four corners; and a storage case having four case perimeter side walls and including a lower half and an upper half connected to each other and divided by a zipper extending horizontally along at least two of said four case perimeter side walls.

2. The apparatus of claim 1 wherein said fasteners are clothes pins or clips.

3. The apparatus of claim 1 wherein a curtain is mounted to said at least one of said cross member.

4. The apparatus of claim 1 wherein said wheel assembly is mounted below a platform, said platform supporting and mounted entirely below said container.

5. The apparatus of claim 1 wherein said storage case is adapted to store said collapsible container and said four vertical telescopic poles.

6. The apparatus of claim 5 wherein said storage case is closed using a zipper.

* * * * *